US010458155B2

(12) United States Patent
Yu et al.

(10) Patent No.: US 10,458,155 B2
(45) Date of Patent: Oct. 29, 2019

(54) LATCH WITH OVERSLAM STOP FEATURE

(71) Applicant: Magna Closures Inc., Newmarket (CA)

(72) Inventors: Jianjun Yu, Huaian (CN); Hongying Wang, Anting Town (CN); Hongyuan Li, Kunshan (CN)

(73) Assignee: MAGNA CLOSURES INC., Newmarket (CA)

( * ) Notice: Subject to any disclaimer, the term of this patent is extended or adjusted under 35 U.S.C. 154(b) by 266 days.

(21) Appl. No.: 15/371,688

(22) Filed: Dec. 7, 2016

(65) Prior Publication Data

US 2017/0167168 A1 Jun. 15, 2017

(30) Foreign Application Priority Data

Dec. 11, 2015 (CN) ..... 2015 1 0920604

(51) Int. Cl.
*E05B 77/08* (2014.01)
*E05B 77/54* (2014.01)
*E05B 83/24* (2014.01)

(52) U.S. Cl.
CPC ..... *E05B 77/08* (2013.01); *E05B 77/54* (2013.01); *E05B 83/24* (2013.01)

(58) Field of Classification Search
CPC ..... Y10T 292/1047; Y10T 292/1078; Y10T 292/1043; Y10T 292/1044; Y10T 292/1082; E05B 77/02; E05B 77/08; E05B 77/54; E05B 83/24; B60N 2/366; B60N 2/01516; B60N 2/01583; B60N 2/2245; Y10S 292/14; Y10S 292/23; Y10S 292/65; Y10S 292/22
See application file for complete search history.

(56) References Cited

U.S. PATENT DOCUMENTS

2007/0271973 A1* 11/2007 Ottino ..... E05B 77/34 70/237
2014/0246870 A1* 9/2014 Kim ..... E05B 83/24 292/216
2015/0145263 A1* 5/2015 Farris ..... E05B 83/24 292/195
2016/0340941 A1* 11/2016 Taurasi ..... E05B 83/24

* cited by examiner

*Primary Examiner* — Alyson M Merlino
(74) *Attorney, Agent, or Firm* — Dickinson Wright PLLC

(57) ABSTRACT

A latch for a closure panel of a vehicle including a latch housing; a ratchet mounted to the latch housing and movable between a closed position and an open position, the ratchet having a channel for receiving a striker with a first portion relative to the channel and a second portion relative to the channel, the channel having an over slam region positioned adjacent to a bottom of the channel; a pawl mounted to the latch housing and movable between a ratchet holding position and a ratchet release position; and a pair of levers mounted to the latch housing and configured for corotation about a pivot, the pair of levers biased towards a rest position by a biasing member coupled to at least one of the pair of levers.

10 Claims, 7 Drawing Sheets

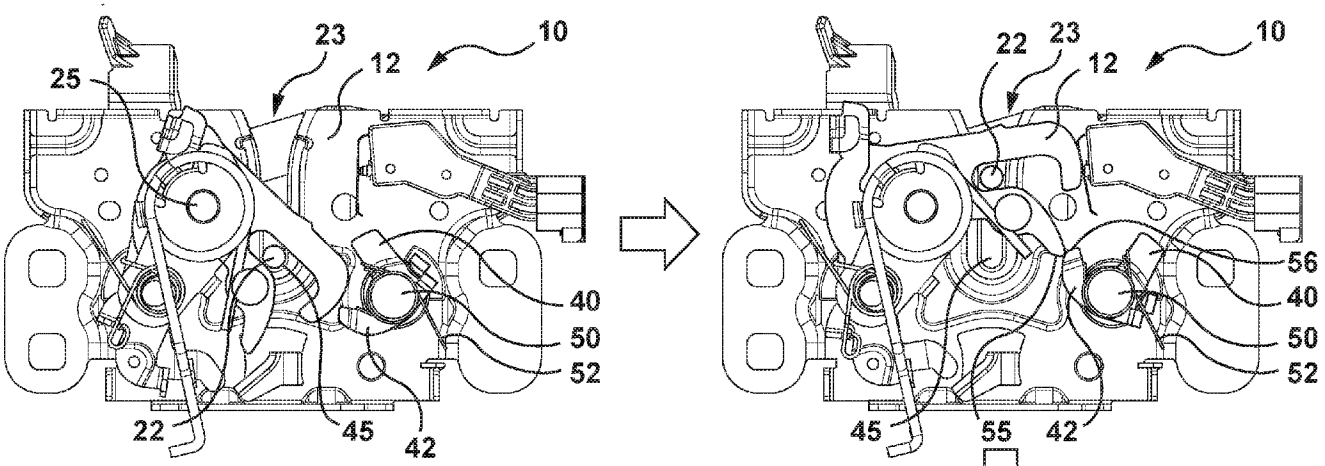
FIG. 7a
FIG. 7b
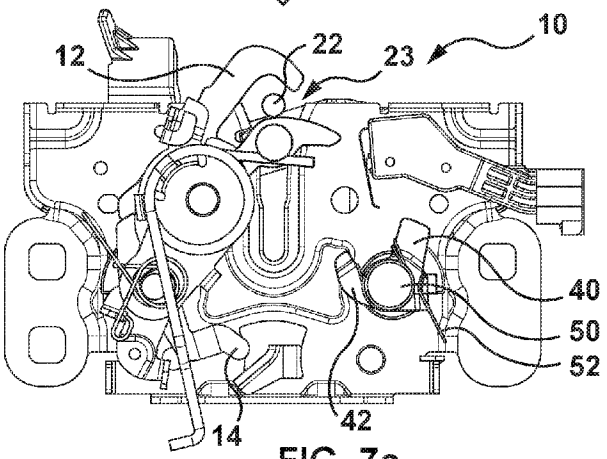
FIG. 7c
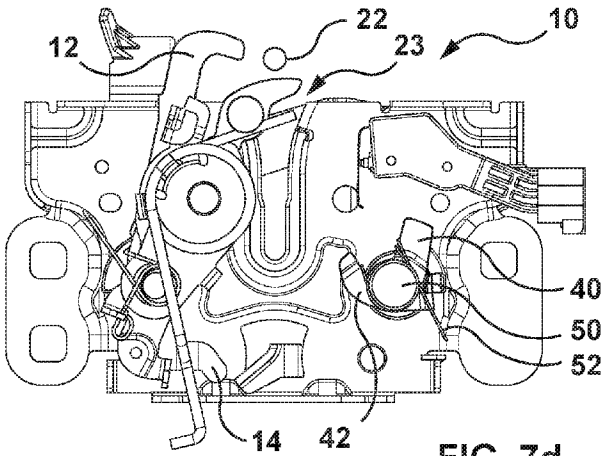
FIG. 7d

LATCH WITH OVERSLAM STOP FEATURE

CROSS-REFERENCE TO RELATED APPLICATION

This application claims the benefit and priority of Chinese patent application No. 201510920604.2, filed Dec. 11, 2015. The entire disclosure of the above application is incorporated herein by reference.

FIELD

The present disclosure relates to latches for closure panels and more particularly to vehicle hood latches.

BACKGROUND

Latches for vehicle hoods and the like are typically actuated in two stages. During a first stage a handle is actuated inside the vehicle which moves the latch from a primary closed position to secondary closed position. To release the latch completely the vehicle occupant typically can either exit the vehicle and actuate a lever that is under the hood or can activate the handle during a second stage (e.g. double pull) from inside of the vehicle to move the patch from the secondary closed position to the open position.

In terms of lifting a hood in general and specifically for an active pedestrian protection system, the latch is needed to provide a travel that is greater than (e.g. over travel of the striker within the slot of the latch) that which is used for normal opening. Due to mechanical limitations of springs and targets for mass and packaging, the normal opening lift of the hood cannot be as high as compared to what is provided using the active pedestrian protection system. There is a need for automatic reset of the latch when an over slam condition is encountered due to a pedestrian impact with the hood. There is also a need for normal operation of the same latch (e.g. outside of an over slam condition) where the extra travel is not utilized.

The automotive industry is attempting to better protect pedestrians from head on collisions with vehicles. When a car hits a pedestrian in a front collision, the pedestrian can be thrown up and land on the front hood of the vehicle and/or the windshield. In an effort to ameliorate the harshness of the impact, and in particular to prevent the person's head from hitting the engine block or other hard point located directly underneath the front hood, it is desired to actively space the front hood from the engine block whenever a front end collision is detected.

SUMMARY

It is an object of the present invention to provide a latch to obviate or mitigate at least some of the above presented disadvantages.

A first aspect provided is a latch for a closure panel of a vehicle, the latch including: a latch housing; a ratchet mounted to the latch housing and movable between a closed position in which the ratchet retains a striker in a slot of the latch housing and an open position in which the ratchet releases the striker from the slot, the ratchet having a channel for receiving the striker with a first portion relative to the channel and a second portion relative to the channel, the channel having an over slam region positioned adjacent to a bottom of the channel; a pawl mounted to the latch housing and movable between a ratchet holding position in which the pawl holds the ratchet in the closed position and a ratchet release position in which the pawl facilitates ratchet movement towards the open position; and a pair of levers mounted to the latch housing and configured for corotation about a pivot, the pair of levers biased towards a rest position by a biasing member coupled to at least one of the pair of levers, the pair of levers including a control lever and a stop lever spaced apart from one another about the pivot, such that when in the rest position the control lever is in alignment for contact by the first portion to facilitate co-joint rotation of the ratchet and the pair of levers when in said contact by acting against the bias of the biasing element for: rotation of the ratchet over a predefined speed threshold causing the corotation to bring into contact the second portion and the stop lever inhibiting travel of the striker into the over slam region of the channel; and rotation of the ratchet under the predefined speed threshold causing the corotation to misalign and inhibit contact of the second portion and the stop lever facilitating travel of the striker into the over slam region of the channel; wherein said predefined speed threshold is relative to a biasing strength of the biasing member.

BRIEF DESCRIPTION OF THE DRAWINGS

The foregoing and other aspects will now be described by way of example only with reference to the attached drawings, in which:

FIGS. 7*a*,7*b*,7*c*,7*d* show a progression of the latch operation from the over slam condition of the latch of FIG. 5 to any of the positions of the patch shown in FIGS. 2,3,4.

DETAILED DESCRIPTION

Figure 1:
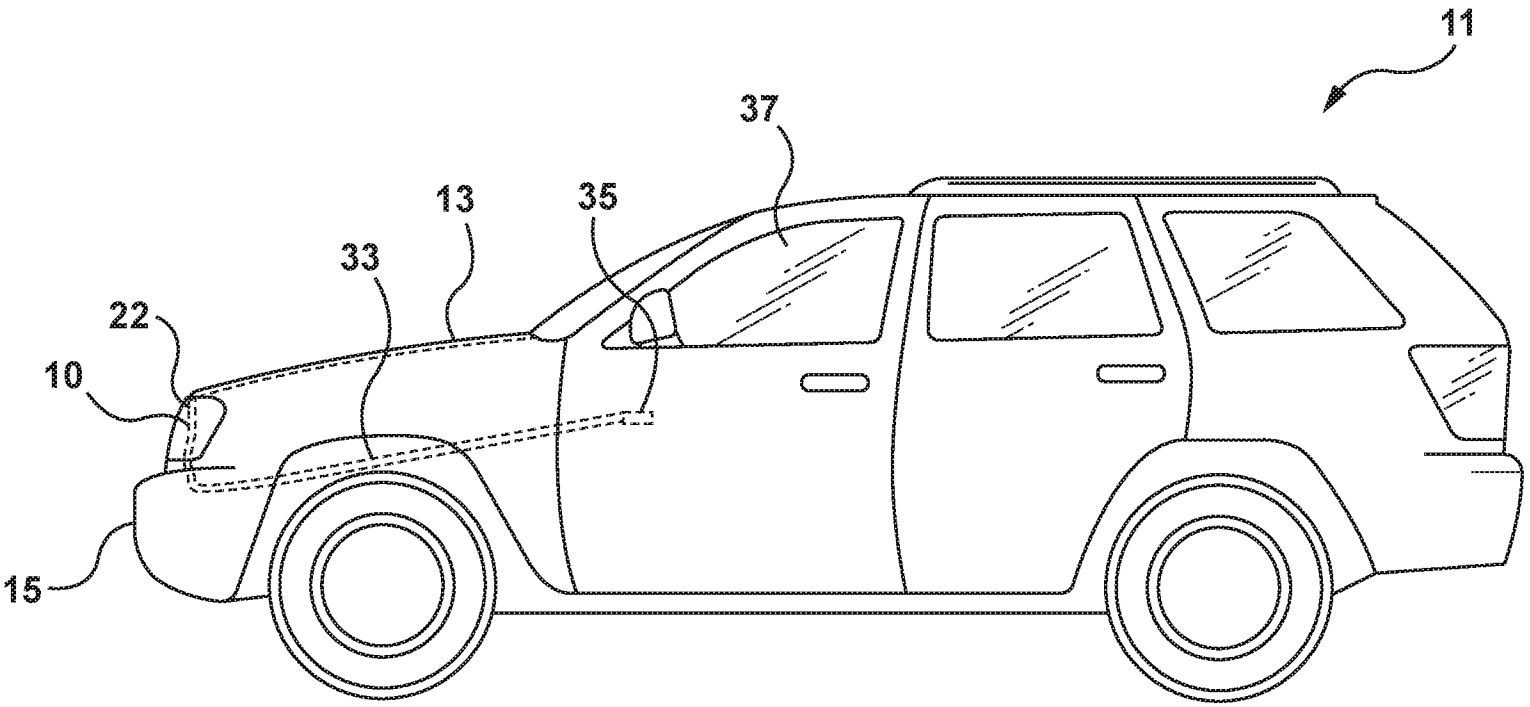
FIG. 1 is a side view of a vehicle.

Reference is made to FIG. 1, which shows a vehicle 11 that has a hood 13 (e.g. closure panel), on which there is a striker 22. The striker 22 is capturable by a latch 10 that is mounted on the body (shown at 15) of the vehicle 11. A vehicle occupant inside the passenger compartment 37 (FIG. 1) actuates (e.g. manually) a release lever 16 (FIG. 2) a first time by pulling a handle 35, such that the handle 35 is coupled to the release lever 16 by cable 33, which disengages the pawl 14 from the ratchet 12.

Figure 2:
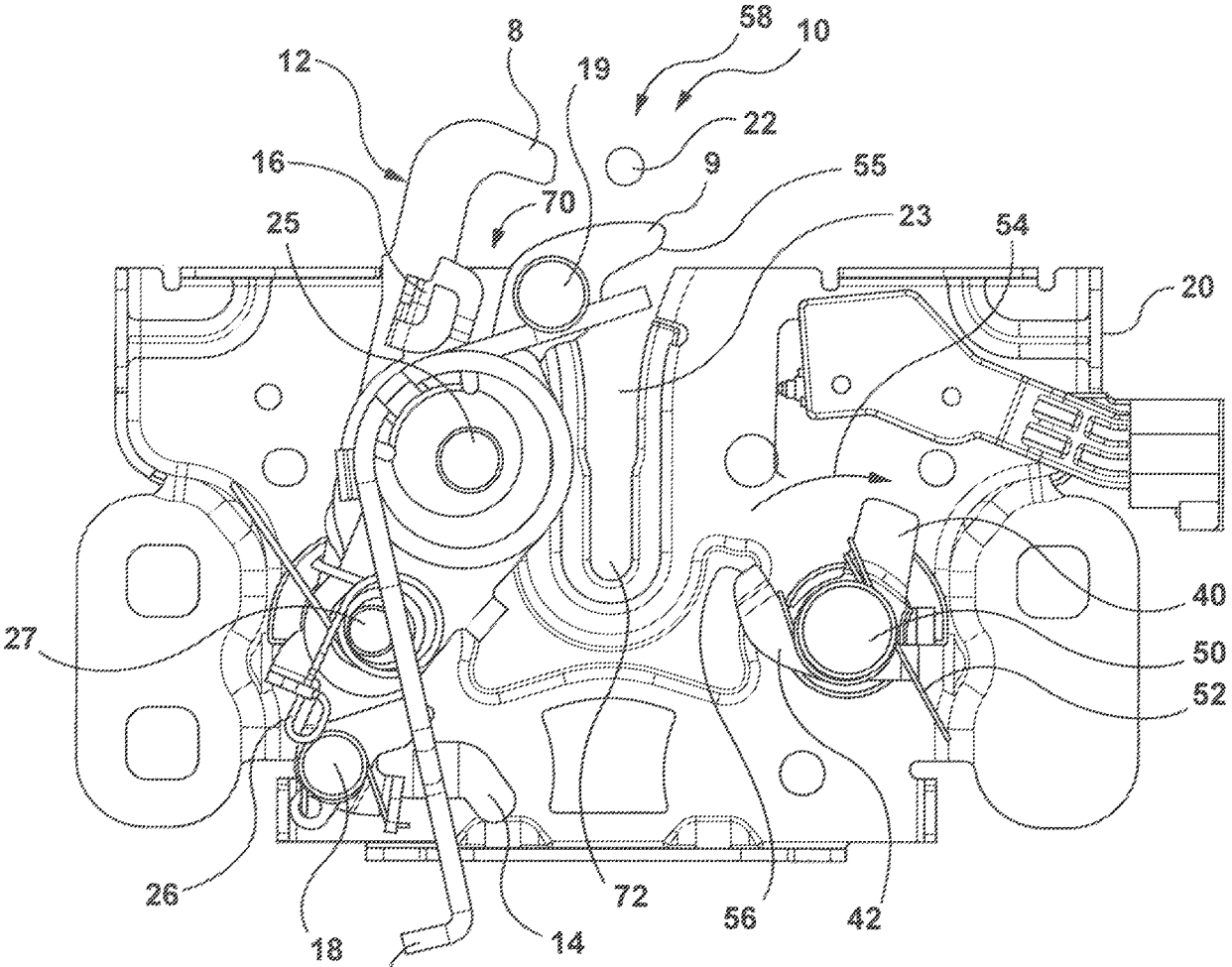
FIG. 2 is a latch of the vehicle of FIG. 1 in an open position.
Figure 3:
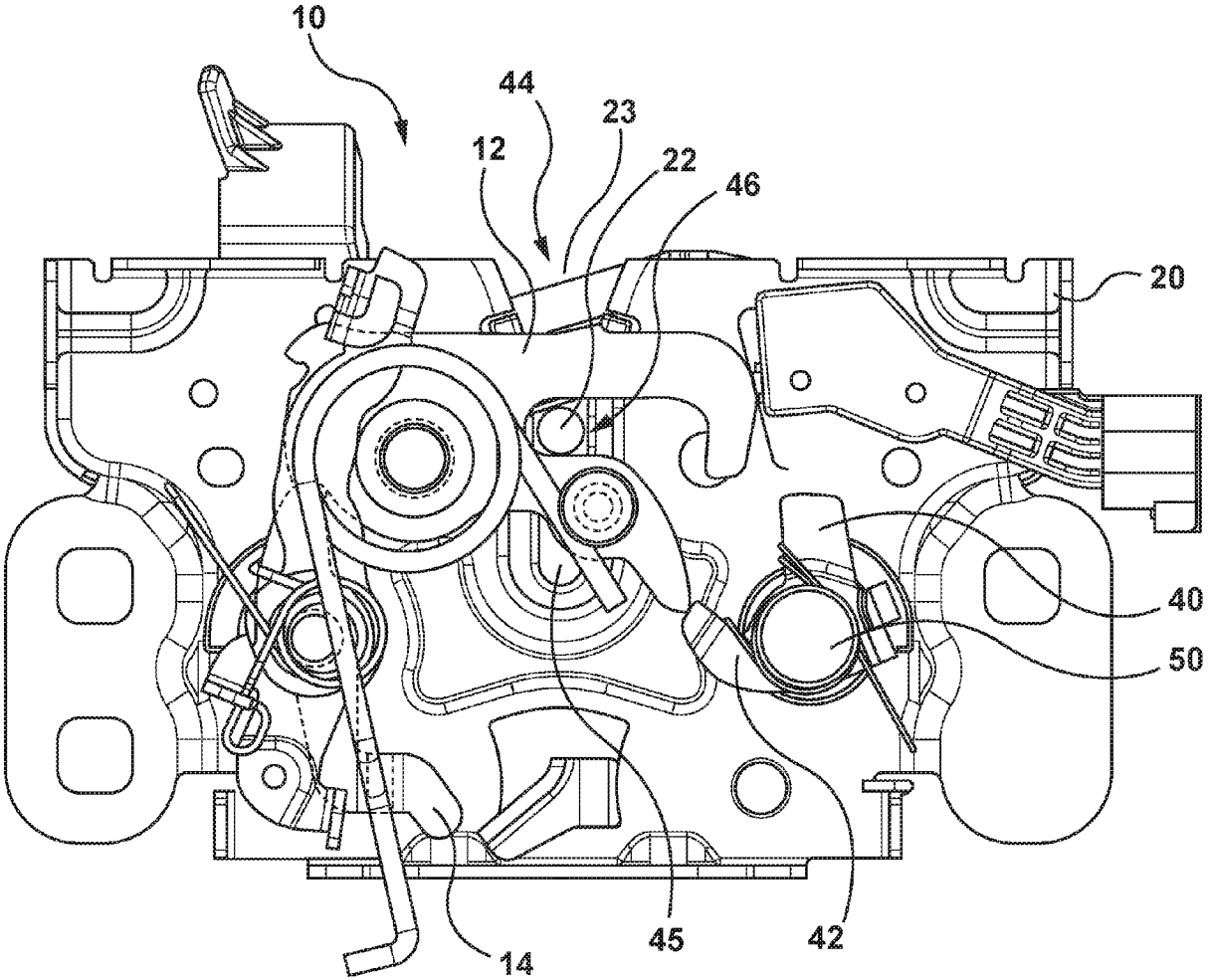
FIG. 3 is the latch of the vehicle of FIG. 1 in a latched position.
Figure 4:
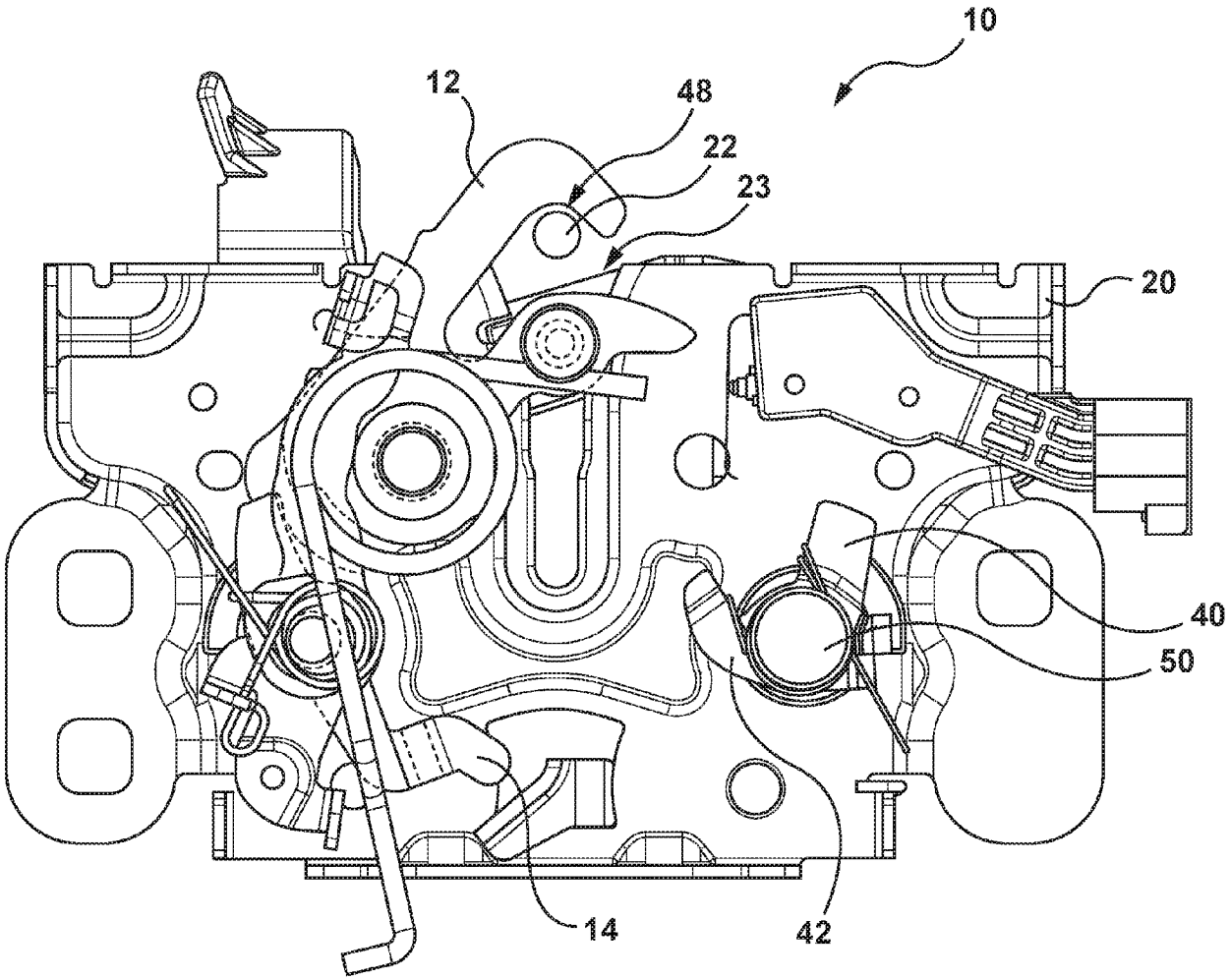
FIG. 4 is the latch of the vehicle of FIG. 1 in a secondary latched position.

Referring to FIG. 2, the latch 10 includes the ratchet 12, the pawl 14, the release lever 16, a stop lever 40, a control or active lever 42, and a housing 20. As shown in FIG. 2, the ratchet 12 is pivotably connected to the housing 20 via a pivot, such as defined by a pin 25, and under normal operation is movable between a primary closed position shown in FIG. 3, a secondary closed position shown in FIG. 4, and the open position shown in FIG. 2. The pivotal movement of the ratchet 12 may take place about a pin 25 (FIG. 2) that is mounted to the housing 20. In the primary and secondary closed positions, the ratchet 12 inhibits the withdrawal of the striker 22 from a fishmouth, also referred to as slot 23, such that the striker 22 is mounted on the vehicle hood 13 or other closure panel from the latch 10.

When in the primary closed position, the ratchet 12 holds the striker 22 relatively deeper into the fishmouth (at a between position 46 between an entrance 44 and a bottom 45 of the slot 23) of the housing 20 than in the secondary closed position at an entrance position 48 which is higher than the between position 46 and thus further away from the bottom 45 than when at the between position 46. Thus, in the primary closed position the ratchet 12 holds the striker 22 at a first depth in the fishmouth 23 of the housing 20, and in the secondary closed position the ratchet 12 holds the striker 22 at a second depth in the fishmouth 23 of the housing 20. It is recognized that the second depth is further away from the bottom 45 than the first depth. Also, it is recognized that the second depth can be below or above the entrance 44 of the slot 23.

In one example, a body of the ratchet 12 can have a hook portion 8 (see FIG. 2) for inhibiting release of the striker 22 from the fishmouth 23 when the pawl 14 and ratchet 12 are in the secondary position (see FIG. 4), which occurs as a result of operated release lever 16 (see FIG. 2) misaligning the pawl 14 from engagement with a locking surface on the ratchet 12 and aligning for subsequent engagement of the pawl 14 with a secondary locking surface on the ratchet 12. Alternatively, the hook potion 8 can be separate from the body of the ratchet 12 and connected to (or otherwise part of) a body of the vehicle 11, the hood 13, and/or the housing 20 of the latch 10. Secondary position of the ratchet 12 is defined as the position of the striker 22 in the fishmouth 23 that is distanced away from the primary or locked position while at the same time having the striker 22 being restricted by the hook portion 8 from leaving the fishmouth 23 (i.e. placing the latch 10 in an open state).

Referring again to FIG. 2, the ratchet 12 is biased towards the open position by a ratchet biasing member 24. The ratchet biasing member 24 can be, for example, a torsion spring. The torsion spring may extend around the pin 25 and may have a first end 24*a* (FIG. 2) anchored in a slot of the housing 20 and a second end that acts against an engagement member or spring holder 19 on the ratchet 12. The pawl 14 is pivotably connected to the housing 20 and is movable between the primary locking position (FIG. 3), the secondary locking position (FIG. 4) and the unlocking position (FIG. 2). The pivotal movement of the pawl 14 can be about a pin 27 (FIG. 2). In the primary locking position (FIG. 3) a pawl locking on the pawl 14 engages a primary locking surface on the ratchet 12 and holds the ratchet 12 in the primary closed position, until released using the primary release lever 16. In the secondary locking position (FIG. 4), the pawl locking surface can engage a secondary locking surface on the ratchet 12 to hold the ratchet 12 in the secondary closed position, until released by activation of a secondary or double pull lever 18. In the unlocking position (FIG. 2) the pawl 14 provides for the ratchet 12 to move to the open position as unhindered by the pawl 14. The pawl 14 is biased towards the primary locking position by a pawl biasing member 26 (FIG. 2). The pawl biasing member 26 may be, for example, a torsion spring. The torsion spring may extend around the pin 27 and have a first end and a second end anchored on the housing 20.

Referring again to FIG. 2, the stop lever 40 and the control lever 42 pivot in conjunction with one another about a pivot 50. A biasing member 52 anchored to the housing 20 biases in a clockwise direction 54 away from the ratchet 12. The body of the ratchet 12 has the hook portion 8, as well as an over slam portion 9 having contact portion 55 configured for engagement with a contact portion 56 of the control lever 42 during normal operation or over slam operation of the latch 10. In normal operation of the latch 10 travel of the striker 22 between the between position 46 (see FIG. 3) and the bottom 45 is inhibited by the stop lever 40 as further described below. In over slam operation of the latch 10 travel of the striker 22 between the between position 46 (see FIG. 3) and the bottom 45 is facilitated as further described below. In terms of lifting the hood 13 in general and specifically for an active pedestrian protection system which is considered an appropriate over slam condition, the latch 10 is needed to provide a travel that is greater than (e.g. over travel of the striker 22 within the slot 23 of the latch 10) that which is used for normal opening.

Normal opening travel of the striker 22 is for a range of striker 22 travel including progression from the between position 46 (see FIG. 3) to the entrance position 48 (see FIG. 4 at the secondary close position) to an open position 58 (see FIG. 2 at the latch open position) and vice versa upon closing of the latch 10. Hence travel of the striker 22 between the open position 58 and the between position 46 via the entrance 48 position is considered normal operating range of the striker 22 which does not utilize any over travel (e.g. striker 22 travel between the between position 46 and the bottom 45 of the slot 23—see FIG. 3). As such, normal operation of the latch 10 (e.g. outside of an over slam condition) where the extra travel potential of the striker 22 is not utilized.

Figure 5:
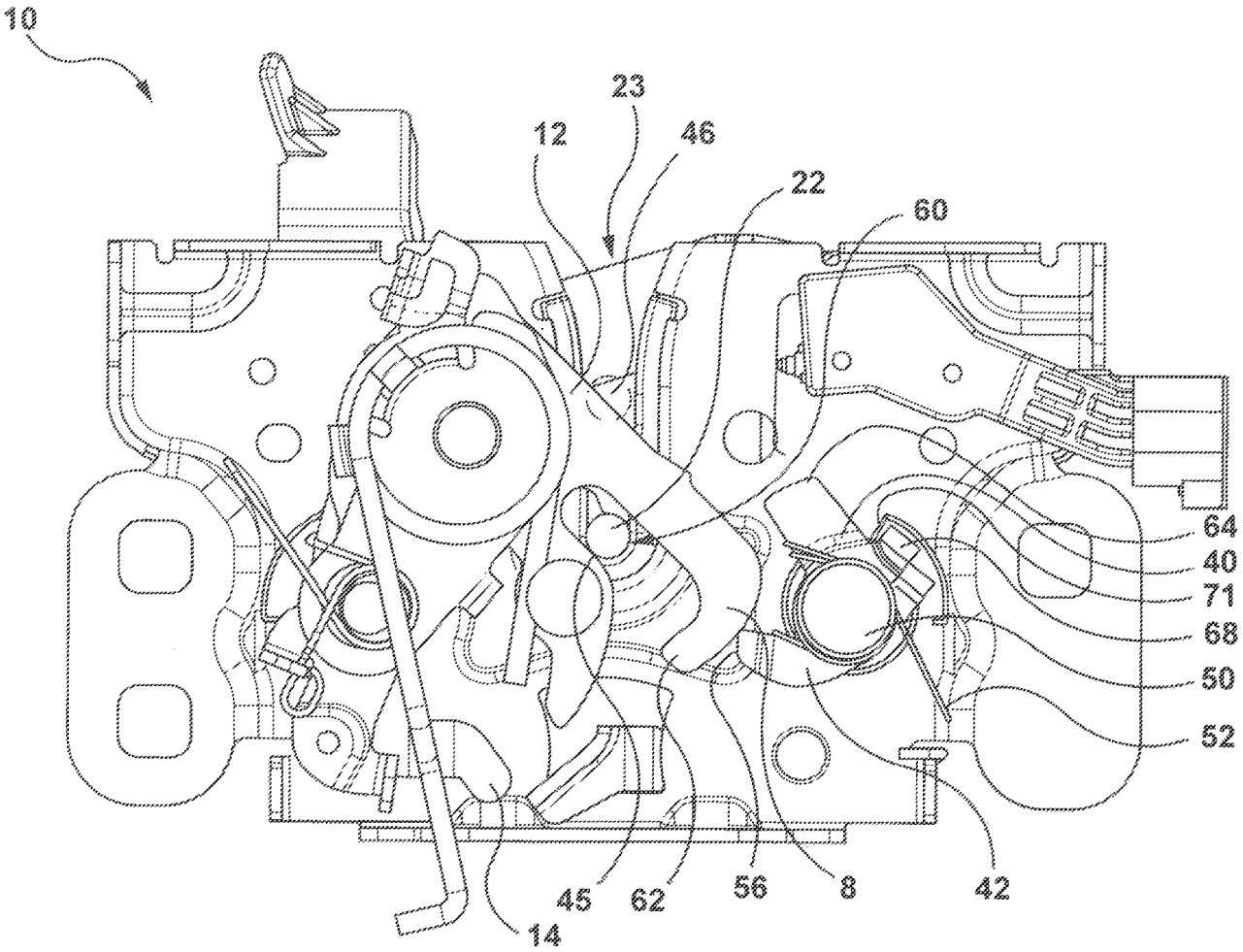
FIG. 5 is the latch of FIG. 1 in an over slam condition.

For an over slam condition, the extra travel potential of the striker 22 between the between position 46 and the bottom 45 of the slot 23 is utilized, such that the travel of the striker 22 surpasses the between position 46 and approaches or otherwise contacts the bottom 45, see FIG. 5. It is noted that in an over slam position 60 of the striker 22, a contact surface 62 of the hook portion 8 of the ratchet 12 has bypassed a contact surface 64 of the stop lever 40, as further described below.

Figure 6B:
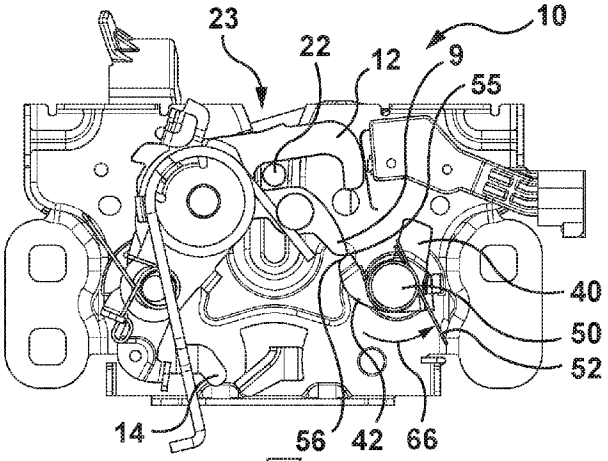
FIGS. 6*a*,6*b*,6*c*,6*d* show a progression of the latch operation from open to the latched position of FIG. 3.
Figure 6A:
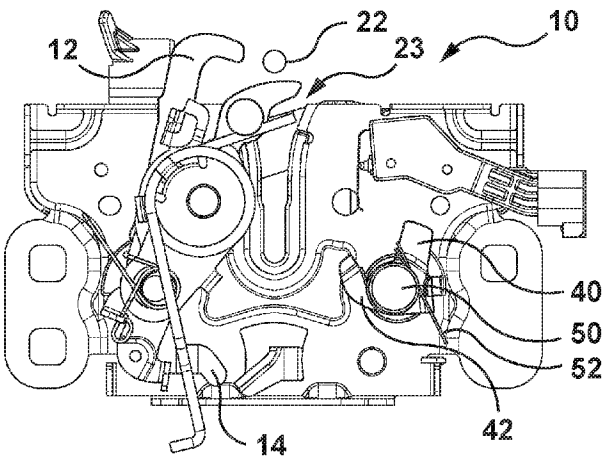
Figure 6C:
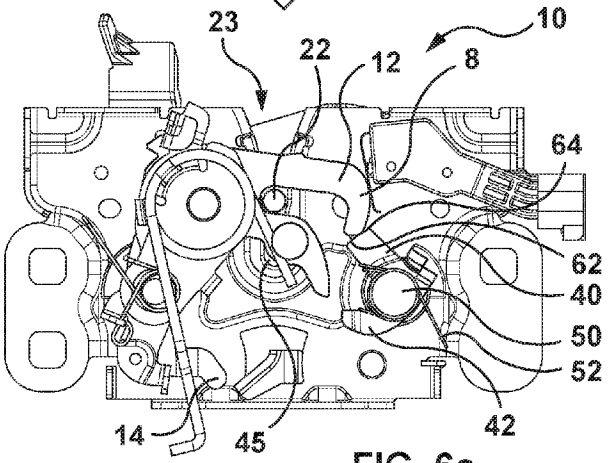
Figure 6D:
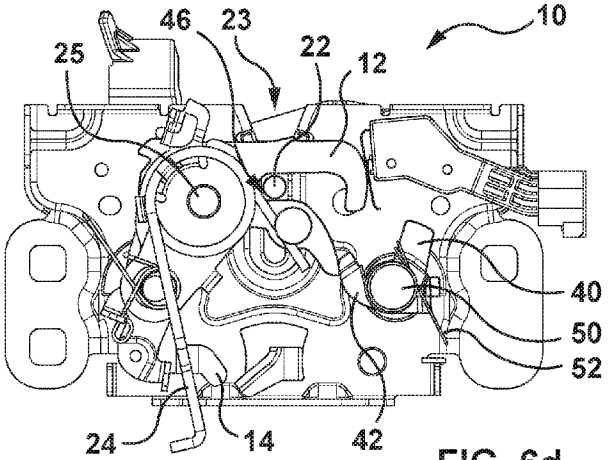

Referring to FIGS. 6*a*, 6*b*, 6*c*, 6*d*, normal operation is shown of the latch 10 from the open position of FIG. 6*a* (same as FIG. 2) towards a latched position (e.g. primary closed position) of FIG. 6*d* (same as FIG. 3) via engagement of the ratchet 12 with the control lever 42 in FIG. 6*b* and subsequently with the stop lever 40 in FIG. 6*c*. Bias of the control lever 42 and the stop lever 40 in the clockwise direction 54 (see FIG. 2) by the biasing element 52 is overcome by downward travel of the striker 22 in the slot 23 when the contact portion 55 of the ratchet 12 engages with the contact portion 56 of the control lever 42. Thus continued engagement of the contact portions 55, 56 causes work against the bias of the biasing element 52 (e.g. loads the spring 52) as both the control lever 42 and stop lever 40 rotate counterclockwise 66 about pivot 50 in order to bring into engagement contact portion 62 of the ratchet 12 with contact portion 64 of the stop lever 40 in FIG. 6*c*. Referring to FIG. 5, once abutment surface 68 of the stop lever 40 rotates about pivot 50 and engages with a stop abutment 71 (e.g. on the housing 20), counterclockwise rotation 66 is inhibited, thus inhibiting any further travel of the striker 22 towards the bottom 45 of the slot 23 (see FIG. 6*c*). After engagement of the abutment surface 68 with stop abutment 71, bias of the ratchet biasing member 24 causes counterclockwise rotation of the ratchet 12 about pivot 25 (see FIG. 6*d*) thus bringing out of engagement the contact portions 62, 64 thus facilitating rotation clockwise 54 (see FIG. 2) of the control lever 42 and the stop lever 40 under bias of the loaded biasing member 52 back towards a rest position of the control lever 42 and the stop lever 40 (see FIG. 6*d*). As stated above, the ratchet 12 in FIG. 6*d* is now in the primary latched position.

As described, engagement of the hook portion 9 of the ratchet 12 with the stop lever 40 inhibited any range of striker 22 travel into an over slam region of the slot 23, i.e. between the between portion 46 towards the bottom 45 of the slot. Also as described, engagement of the ratchet 12 with the control lever 42 brings into alignment the stop lever 40 with the hook portion 8 of the ratchet 12 under normal operation of the latch 10, i.e. the ratchet 12 actives the control lever 42 to rotate about the pivot 50 in conjunction with rotation of the stop lever 40 as it is coupled to the rotation of the control lever 42. It is recognized that a preselected biasing strength (e.g. spring size) of the biasing member 52, based on speed of rotation of the ratchet 12 about pivot 25, provides for meeting of the contact portions 62, 64 in space when the speed of rotation is above a predetermined speed threshold, e.g. corresponding to 1 m/s of striker 22 downwards travel in the slot 23 towards the bottom 45. In other words, the stop lever 40 can stop the ratchet 12 travel about the pivot 25 at the dynamic slam position under normal operation (e.g. above the predetermined speed threshold) shown in FIG. 6*c* in accordance with the specific selected spring rate range of the biasing member 52 and slam speed of the striker 22. Meeting of the contact portions 55, 56 is enabled when the speed of rotation of the ratchet 12 about the pivot 25 is matched with the speed of rotation of the stop lever 40 about the pivot 50 once the contact portions 62, 64 are engaged, which can occur when the speed of striker 22 travel is calibrated with the biasing strength of the biasing member 52 for speeds above the predetermined speed threshold.

Speeds below the speed threshold can be produced in accident situations when a pedestrian impacts the hood 13 with force during a pedestrian-vehicle 11 collision. As shown in FIG. 5, the striker 22 was driven down towards the bottom 45 at a speed lower than the speed threshold (e.g. speed lower than 1 m/s). In this manner, the contact portions 55, 56 were engaged to cause initial corotation of the control lever 42 about the pivot 50 in conjunction with rotation of the stop lever 40 in the clockwise direction 66 (see FIG. 6*b*), however due to the bias strength of the biasing member 52, travel of the hook portion 8 about the pivot 25 was faster than travel of the stop lever 40 about the pivot 50 and thus the contact portions 62, 64 bypassed one another (e.g. did not reach alignment) thus facilitating travel of the striker 22 in the over slam travel region of the slot 23 (i.e. between the between position 46 and the bottom 45 as seen in FIG. 5. In other words, meeting of the contact portions 55, 56 is discouraged when the speed of rotation of the ratchet 12 about the pivot 25 is unmatched with the speed of rotation of the stop lever 40 about the pivot 50 once the contact portions 62, 64 are engaged, which can occur when the speed of striker 22 travel is calibrated with the biasing strength of the biasing member 52 for speeds below the predetermined speed threshold.

It is also recognized that an alternative configuration of the latch 10 with levers 40, 42 can be such that bias of the control lever 42 and the stop lever 40 in the counter clockwise direction 54 with the position of the levers 40, 42 about their pivot reversed (not shown). Accordingly, the biasing element 52 is overcome by downward travel of the striker 22 in the slot 23 when the contact portion 55 of the ratchet 12 engages with the contact portion 56 of the control lever 42. Speeds below the speed threshold can be produced in accident situations when a pedestrian impacts the hood 13 with force during a pedestrian-vehicle 11 collision. The striker 22 can be driven down towards the bottom 45 at a speed lower than the speed threshold (e.g. speed lower than 1 m/s). In this manner, the contact portions 55,56 are engaged to cause initial corotation of the control lever 42 about the pivot 50 in conjunction with rotation of the stop lever 40 in the counter clockwise direction 66, however due to the bias strength of the biasing member 52, travel of the hook portion 8 about the pivot 25 would be faster than travel of the stop lever 40 about the pivot 50 and thus the contact portions 62, 64 would bypass one another (e.g. did not reach alignment) thus facilitating travel of the striker 22 in the over slam travel region of the slot 23 (i.e. between the between position 46 and the bottom 45 as seen in FIG. 5). As well, meeting of the contact portions 55, 56 is enabled when the speed of rotation of the ratchet 12 about the pivot 25 is matched with the speed of rotation of the stop lever 40 about the pivot 50 once the contact portions 62, 64 are engaged, which can occur when the speed of striker 22 travel is calibrated with the biasing strength of the biasing member 52 for speeds above the predetermined speed threshold.

As such, the latch 10 for the closure panel 13 of the vehicle 11 can include the latch housing 20, the ratchet 12 mounted to the latch housing 20 and movable between the closed position (first or secondary closed position) in which the ratchet 12 retains the striker 22 in the slot 23 of the latch housing 20 and the open position in which the ratchet 12 releases the striker 22 from the slot 23, the ratchet 12 having a channel 70 (see FIG. 2) for receiving the striker 22 with a first portion 9 relative to the channel 70 and a second portion 8 relative to the channel 70, the channel 70 having an over slam region 72 (see FIG. 2) positioned adjacent to the bottom 45 of the channel 70, and the pawl 14 mounted to the latch housing 20 and movable between a ratchet holding position in which the pawl 14 holds the ratchet 12 in the closed position and a ratchet release position in which the pawl 14 facilitates ratchet 12 movement towards the open position.

Also provided is a pair of levers 40, 42 mounted to the latch housing 20 and configured for corotation about the pivot 50, the pair of levers 40, 42 biased towards the rest position by the biasing member 52 coupled to at least one of the pair of levers 40, 42, the pair of levers including the control lever 42 and the stop lever 40 spaced apart from one another about the pivot 50, such that when in the rest position the control lever 42 is in alignment for contact by the first portion 9 to facilitate co-joint rotation of the ratchet 12 and the pair of levers 40, 42 when in the contact by acting against the bias of the biasing element 52 for: 1) rotation of the ratchet 12 over a predefined speed threshold causing the corotation to bring into contact the second portion 8 and the stop lever 40 inhibiting travel of the striker 22 into the over slam region of the channel 70; and 2) rotation of the ratchet 12 under a predefined speed threshold causing the corotation to misalign and inhibit contact of the second portion 8 and the stop lever 40 facilitating travel of the striker 22 into the over slam region 72 of the channel 70; wherein the predefined speed threshold is relative to the biasing strength of the biasing member 52.

Referring to FIGS. 7*a*, 7*b*, 7*c*, 7*d*, resetting and subsequent opening of the latch 10 is shown after the over slam condition of FIG. 5 was reached. The latch 10 in FIG. 7*d* is in the same position/state as that of the latch 10 in FIG. 5, namely an over slam state. The latch 10 of FIG. 7*b* is in the same state as that of the latch 10 in FIG. 3. The latch 10 of FIG. 7*c* is in the same state as that of the latch 10 in FIG. 4. The latch 10 of FIG. 7*d* is in the same state as that of the latch 10 in FIG. 2. It is noted that in transition of the latch 10 state from the over slam condition of FIG. 7*a* to that of the latch state of primary closed or latched position of FIG.

7*b*, rotation (e.g. counterclockwise) of the ratchet 12 about pivot 25 (as the striker 22 moves away from the bottom 45) facilitates corotation (e.g. clockwise) of the control lever 42 and the stop lever 40 about pivot 50 in order for the stop lever 40 and the control lever 42 to return to their rest position (see FIG. 7*b*). The rest position can be defined as the position of the control lever 42 and the stop lever 40 about pivot 50 prior to engagement of the contact portions 55, 56 when the striker 22 is travelling downwards in the slot 23 towards the bottom 45. Impetus for corotation of the control lever 42 and the stop lever 40 about pivot 50 from the over slam condition/state of the latch 10 towards the rest position can be facilitated by the bias of the biasing member 52 (e.g. which is loaded when in the over slam state). Alternatively or on addition to, impetus for corotation of the control lever 42 and the stop lever 40 about pivot 50 from the over slam condition/state of the latch 10 towards the rest position can be facilitated by contact between the portion(s) 8, 9 of the ratchet 12 with one or more of the control lever 42 and/or the stop lever 40 as the ratchet 12 rotates about the pivot 25 away from the over slam position and towards the primary latched position. As shown in FIGS. 7*c* and 7*d*, once the control lever 42 and the stop lever 40 are in the rest position, operation of the latch 10 via the release levers 16, 18 can be used to operate the latch 10 to the secondary position and/or the open position. It is appreciated that when returned from the over slam position (FIGS. 5, 7*a*) to any of the primary latched position (FIGS. 3, 7*b*), the secondary latched position (FIGS. 4, 7*c*) or the open position (FIGS. 2, 7*d*), the control lever 42 and the stop lever 40 are in the rest position and as such are in position to inhibit return of the latch 10 to the over slam position (FIGS. 5, 7*a*) when the hood 13 is pushed down with striker 22 travel in the slot 23 at a speed less than the predetermined threshold as discussed above with reference to FIGS. 6*a*-6*d*.

It is recognized that the above discussed operation of the control lever 42 and the stop lever 40 to: 1) inhibit travel of the striker 22 from into the over slam range provided by the slot 23 (FIGS. 6*a*-6*d*); 2) permit travel of the striker 22 from into the over slam range provided by the slot 23 (FIGS. 5,7*a*); and permit travel of the striker from the over slam position back towards an latched or open position (FIGS. 7*a*-7*d*) was illustrated by example only with reference to a double pull (or single pull with manual release second stage) configured latch 10. It is also recognized that the hook portion 8 of the ratchet 12 could be configured so as to engage with the stop lever 40 while providing a latch operating as a single stage release latch (i.e. operating from latched to open and from open to latched with no intermediate secondary latch position provided).

We claim:

1. A latch for a closure panel of a vehicle, the latch including:

a latch housing;

a ratchet mounted to the latch housing and movable between at least one closed position, in which the ratchet retains a striker in a slot of the latch housing, and an open position, in which the ratchet releases the striker from the slot, the ratchet having a channel for receiving the striker between a first portion of the ratchet and a second portion of the ratchet, the slot having an over slam region positioned adjacent to a bottom of the slot;

a pawl mounted to the latch housing and movable between a ratchet holding position, in which the pawl holds the ratchet in the at least one closed position, and a ratchet release position, in which the pawl facilitates movement of the ratchet towards the open position; and a pair of levers mounted to the latch housing and configured for corotation about a pivot, the pair of levers biased towards a rest position by a biasing element coupled to at least one of the pair of levers, the pair of levers including a control lever and a stop lever spaced apart from one another about the pivot, such that when in the rest position, the control lever is in alignment for contact by the first portion of the ratchet to facilitate co-joint rotation of the ratchet and the pair of levers when in said contact by acting against the bias of the biasing element for:

rotation of the ratchet over a predefined speed threshold causing the corotation of the pair of levers to bring into contact the second portion of the ratchet and the stop lever, thereby inhibiting travel of the striker into the over slam region of the slot; and rotation of the ratchet under the predefined speed threshold causing the corotation of the pair of levers to misalign with the second portion of the ratchet and inhibit contact of the second portion of the ratchet with the stop lever, thereby facilitating travel of the striker into the over slam region of the slot;

wherein said predefined speed threshold is relative to a biasing strength of the biasing member.

2. The latch of claim 1, wherein the at least one closed position of the ratchet includes a primary closed position and a secondary closed position.

3. The latch of claim 2, wherein the second portion of the ratchet is a hook portion extending from a bottom of the channel and the first portion of the ratchet extends from the bottom of the channel and is opposed to the second portion.

4. The latch of claim 2 further comprising a primary release lever for releasing the ratchet into the secondary closed position and a double pull lever for releasing the ratchet into the open position.

5. The latch of claim 1, further comprising the ratchet mounted on one side of the slot and the pair of levers mounted on another side of the slot, such that the co-joint rotation of the ratchet and the pair of levers is opposite to one another.

6. The latch of claim 1, wherein the biasing strength of the biasing element provides for a return of the pair of levers to the rest position when the striker leaves the over slam region of the slot and returns towards an entrance of the slot.

7. The latch of claim 1, wherein a return of the pair of levers to the rest position is facilitated by aligned contact and co-joint rotation between the second portion of the ratchet and the stop lever.

8. The latch of claim 1, wherein the closure panel is a hood of the vehicle.

9. The latch of claim 1, wherein the first portion and the second portion delimit the channel in the ratchet.

10. A latch for a closure panel of a vehicle, the latch including:

a latch housing;

a ratchet mounted to the latch housing and movable between at least one closed position, in which the ratchet retains a striker in a slot of the latch housing, and an open position, in which the ratchet releases the striker from the slot, the ratchet having a first portion and a second portion delimiting a channel for receiving the striker, the slot having an over slam region positioned adjacent to a bottom of the slot;

a pawl mounted to the latch housing and movable between a ratchet holding position, in which the pawl holds the ratchet in the at least one closed position, and a ratchet release position, in which the pawl facilitates movement of the ratchet towards the open position; and a pair of levers mounted to the latch housing and configured for corotation about a pivot, the pair of levers biased towards a rest position by a biasing element coupled to at least one of the pair of levers, the pair of levers including a control lever and a stop lever spaced apart from one another about the pivot, such that when in the rest position, the control lever is in alignment for contact by the first portion of the ratchet to facilitate co-joint rotation of the ratchet and the pair of levers when in said contact by acting against the bias of the biasing element for:

rotation of the ratchet over a speed threshold causing the corotation of the pair of levers to bring into contact the second portion of the ratchet and the stop lever, thereby inhibiting travel of the striker into the over slam region of the slot; and rotation of the ratchet under the speed threshold causing the corotation of the pair of levers to misalign with the second portion of the ratchet and inhibit contact of the second portion of the ratchet with the stop lever, thereby facilitating travel of the striker into the over slam region of the slot.

* * * * *